United States Patent [19]

Iida et al.

[11] Patent Number: 4,732,548

[45] Date of Patent: Mar. 22, 1988

[54] ENCLOSED TYPE COMPRESSOR

[75] Inventors: Toshikatsu Iida; Eiichi Aikawa, both of Yokohama; Sumio Minagawa, Kawasaki; Takayoshi Fujiwara, Hino, all of Japan

[73] Assignee: Kabushiki Kaisha Toshiba, Kawasaki, Japan

[21] Appl. No.: 73,310

[22] Filed: Jul. 13, 1987

Related U.S. Application Data

[63] Continuation of Ser. No. 800,964, Nov. 22, 1985, abandoned.

[30] Foreign Application Priority Data

Nov. 29, 1984 [JP] Japan ..... 59-252524

[51] Int. Cl.[4] ..... F04B 17/00

[52] U.S. Cl. ..... 417/415; 417/902

[58] Field of Search ..... 417/415, 902, 363, 410, 417/312, 313

[56] References Cited

U.S. PATENT DOCUMENTS

| | | | |
|---|---|---|---|
| 3,147,914 | 9/1964 | Hatten et al. | 417/902 |
| 3,182,901 | 5/1965 | Solomon | 417/415 |
| 3,614,384 | 10/1971 | Heitchue, Sr. | 417/902 |
| 4,127,994 | 12/1978 | Niven | 417/902 |
| 4,348,607 | 9/1982 | Tankred et al. | 310/254 |
| 4,566,865 | 1/1986 | Nishitsuji et al. | 417/902 |

FOREIGN PATENT DOCUMENTS

| | | |
|---|---|---|
| 51-140211 | 12/1976 | Japan . |
| 264408 | 3/1968 | U.S.S.R. . |

*Primary Examiner*—Carlton R. Croyle
*Assistant Examiner*—Timothy S. Thorpe
*Attorney, Agent, or Firm*—Schwartz, Jeffery, Schwaab, Mack, Blumenthal & Evans

[57] ABSTRACT

An enclosed type compressor comprises a casing, a compressor mechanism including a cylinder and a piston reciprocatable in the cylinder provided in the casing, and an electric motor having an output driving shaft also provided vertically in the casing. A main bearing supporting the output shaft is secured to a frame member made of a steel plate at a plurality of positions on both sides of the output shaft and the cylinder of the compression mechanism is secured to the frame member or to the main bearing at positions between the cylinder side securing position of the main bearing and the output shaft as viewed in a plan view.

4 Claims, 9 Drawing Figures

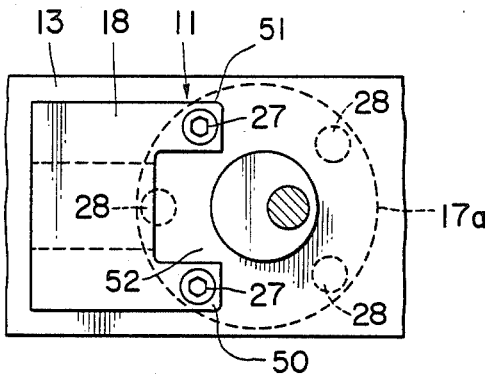
FIG. 6
FIG. 7A
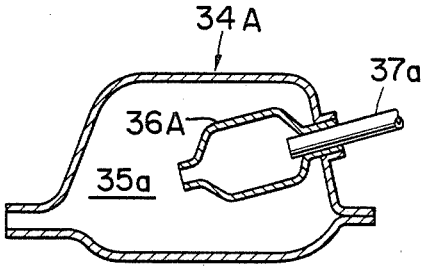
FIG. 7B
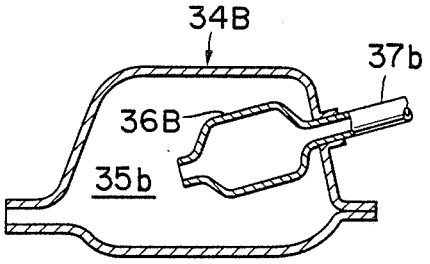

ENCLOSED TYPE COMPRESSOR

This application is a continuation of application Ser. No. 800,964, filed Nov. 22, 1985, now abandoned.

BACKGROUND OF THE INVENTION

This invention relates to an enclosed-type compressor, and more particularly, to a vertical-type reciprocatable enclosed compressor provided with a frame supporting component element, which is an improvement of a U.S. Pat. No. 4,566,865 issued on Jan. 28, 1986, from an application filed July 29, 1983 by K. NISHITSUZI et al and assigned to the same applicant as that of the subject application.

U.S. Pat. No. 4,566,865 discloses a vertical type enclosed compressor wherein an electric motor and a compression mechanism are supported in an enclosing type casing by a frame member made of a metal plate. More specifically as shown in FIG. 1, a cylinder 3 of the compression mechanism 2 and a main bearing 4 that rotatably supports a driving shaft 6 of the electric motor, not shown, are secured to a frame member 1 made of, for instance, a steel plate, by respective sets of securing means such as bolts 5*a* and 5*b* which are driven into the frame member 1 at positions radially spaced apart with respect to the center line of the driving shaft 6 or the main bearing 4. That is, the positions at which the cylinder 7 is secured to the frame 1 by means of a set of bolts 5*a* are radially outwardly spaced apart from the positions at which the main bearing 4 is secured to the frame member 1 by means of a set of bolts 5*b*.

In the above described construction of the conventional enclosed type compressor, when a piston 7 of the compression mechanism is reciprocated in the cylinder 3, a reaction force caused by the compressing movement of the piston 7 creates a bending moment M applied to the frame member 1 as shown in FIG. 2. In order to withstand the bending moment M, a considerable rigidity is required in the part of the frame member 1 supporting the compression mechanism and the electric motor.

However, the rigidity of the frame 1 made of a steel plate is substantially lower than that of a frame made by metal casting, and the rigidity is further reduced in a region between A and B (of a distance l) where the cylinder 3 and the main bearing 4 are secured to the frame 1, respectively. The reduction in turn reduces the rigidity of the entire frame 1, and causes a deviation in the clearance between the stator and rotor of the electric motor. The deviation in the clearance in turn impairs the starting characteristics and stability in operation of the electric motor, thus reducing the reliability of the electric motor.

SUMMARY OF THE INVENTION

A primary object of this invention is to provide an enclosed type compressor wherein the above described drawbacks of the conventional construction can be substantially eliminated.

Another object of this invention is to provide an enclosed type compressor wherein regardless of the frame member made of a steel plate, the rigidity thereof can be increased, and the starting characteristics as well as the stability in operation of the elecric motor can be improved.

These and other objects of the invention can be achieved by an enclosed type compressor which comprises an enclosed-type casing, a compression mechanism provided in the casing and comprising a cylinder and a piston reciprocatable in the cylinder, an electric motor comprising a stator, a rotor and an output driving shaft which extends vertically from the rotor in the casing, a main bearing which rotatably supports the output shaft, a frame member made of a metal plate extending substantially horizontally with respect to the output shaft in the casing, first securing means for securing the main bearing to the frame member at a plurality of positions on both sides of the output shaft, and second securing means for securing the cylinder of the compression mechanism at positions between the cylinder side securing position of the first securing means and the output shaft as viewed in a plan view.

Preferably, the cylinder may be secured to the frame member, or alternatively secured to the main bearing.

BRIEF DESCRIPTION OF THE DRAWINGS

In the accompanying drawings:

FIG. 6 is a plan view taken along the line VI—VI in FIG. 5, a crank portion being omitted for the simplification of the drawing; and FIGS. 7A and 7B are sectional views showing improved constructions of the exhaust-side muffler.

DESCRIPTION OF THE PREFERRED EMBODIMENTS

Figure 1:
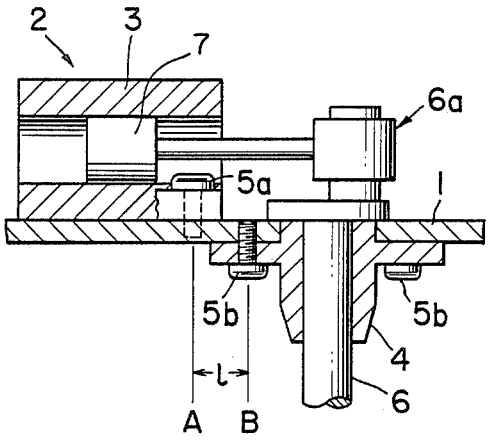
FIG. 1 PRIOR ART
FIG. 1 is a sectional view showing one part of a conventional enclosed type compressor.
Figure 2:
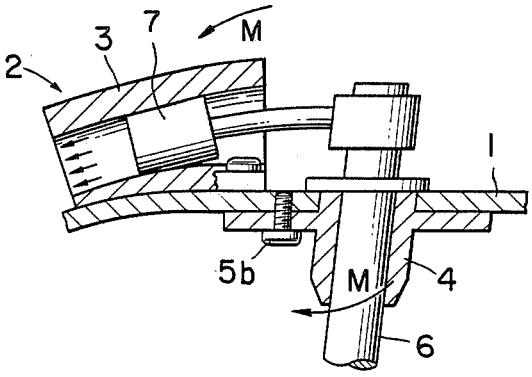
FIG. 2 PRIOR ART
FIG. 2 is a diagram useful for explaining a bending moment applied to a frame member in FIG. 1.
Figure 3:
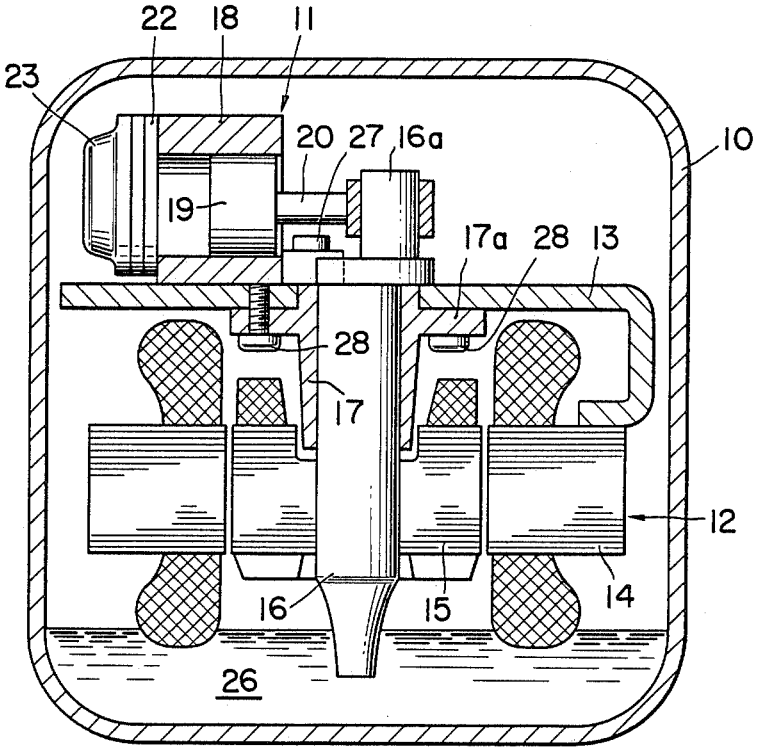
FIG. 3 is a vertical sectional view showing a preferred embodiment of this invention.

Referring to FIG. 3, an enclosed type compressor constituting a preferred embodiment of the invention comprises a casing 10 of a totally enclosed type, a frame member 13 made of a metal plate which extends horizontally in an intermediate portion of the casing 10, a compression mechanism 11 provided in the casing 10 to be mounted on the upper side of the frame member 13, and an electric motor 12 provided in the casing 10 to be mounted on the lower side of the frame member 13. The electric motor 12 comprises a stator 14, a rotor 15 and an output driving shaft 16 that extends vertically out of the rotor 15. A main bearing 17 having a flange portion 17*a* is secured to the frame member 13 for supporting the driving shaft 16 freely rotatably. The upper end of the driving shaft 16 extending upwardly from the bearing 17 is integrally formed into a crank portion 16*a*.

The compression mechanism 11, on the other hand, comprises a cylinder 18 and a piston 19 which is coupled with the crank portion 16*a* of the driving shaft 16 through a piston rod 20. Under the action of the electric motor 12, the piston 19 is reciprocated in the cylinder 18 in accordance with the rotation of the driving shaft 16 through the crank portion 16*a*.

Figure 4A:
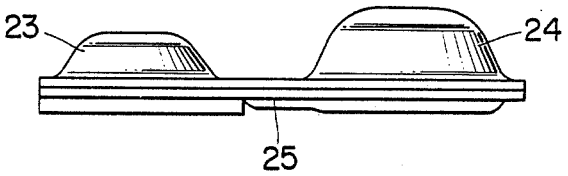
FIGS. 4A and 4B are diagrams showing an exhaust-side muffler and the condition for applying the same.
Figure 4B:
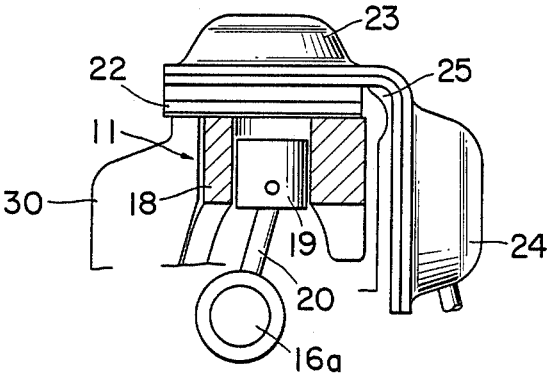

An end of the cylinder 18 opposite to the piston rod 20 is closed by a valve seat member 22 and is covered by a valve cover 23. The valve cover 23 in turn is formed in combination with a delivery side muffler 24 made of a metal plate as shown in FIG. 4A. As described hereinlater in more detail, the valve cover 23 is internally formed with a suction chamber and an exhaust chamber which is communicated with the delivery side muffler 24 through an exhaust passage 25. After the manufacture thereof, the combined unit is bent perpendicularly as shown in FIG. 4B at the passage formed portion, and the valve cover 23 is secured to the outer end of the cylinder 18.

The driving shaft 16 of the electric motor 12 vertically extends in the casing 10 and has a lower end dipped into a lubricating oil 26 stored in the bottom portion of the casing 10. Preferably an oil pump, not shown, is provided at the end of the driving shaft 16 for pumping-up and distributing the lubricating oil 26 to the main bearing 17 or else.

Figure 5:
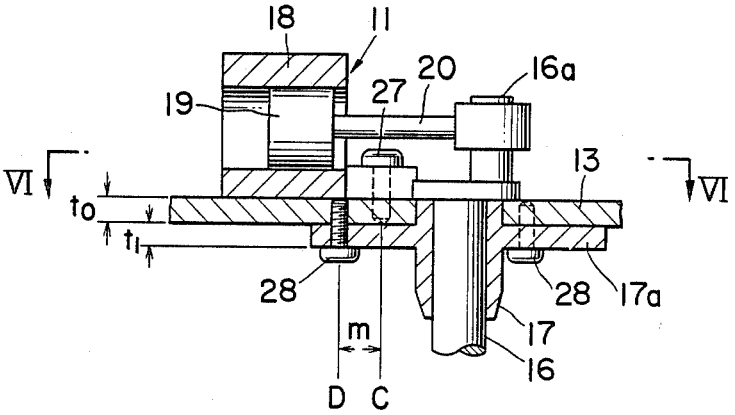
FIG. 5 is a sectional view showing in detail a construction of the frame member used in the embodiment shown in FIG. 3.

In the above described embodiment of this invention, the cylinder 18 of the compression mechanism 11 and the main bearing 17 for supporting the driving shaft 16 of the electric motor 12 are secured to the frame member 13 made of a metal plate by means of bolts 27 and 28, respectively. More specifically, the main bearing 17 has a flange portion 17*a* extending outwardly as shown in FIGS. 5 and 6, which may be secured to a lower surface of the frame member 13 by means of, for instance, three bolts 28. On the other hand, the cylinder 18 of the compression mechanism 11 is secured to the upper side surface of the frame member 13 by means of, for instance, two bolts 27. The positions of the bolts 27 are selected to be nearer to the driving shaft 16 than one of the bolts 28 which is located adjacent to the cylinder 18. More specifically, the bolts 27 securing the cylinder 18 are positioned intermediately between that one of the bolts 28 securing the main bearing 17 and the driving shaft 16 at a position spaced apart from the bolt 28 inwardly by a distance m. Although it has been described that the cylinder 18 and the main bearing 17 are secured to the frame member 13 separately, it may otherwise be so constructed that the cylinder 18 is secured directly to the main bearing 17 which is, in this case, provided through the frame member 1.

The operation of the embodiment shown in FIGS. 3, 5 and 6 will now be described.

When the electric motor 12 is energized, the driving shaft 16 is rotated, and the rotation of the driving shaft 16 reciprocates the piston 19 in the cylinder 18 by means of the crank portion 16*a*. The reciprocation of the piston 19 compresses a coolant, which has been introduced into the cylinder 18 through a suction side muffler 30, FIG. 4B, and a suction chamber, not shown, of the valve cover 23, the compressed coolant being delivered to outside of the compressor through an exhaust chamber, not shown, of the valve cover 23 and through the delivery side muffler 24.

While the piston 19 is reciprocated as described above, a reaction force is created each time when piston 19 compresses the coolant, and the reaction force in turn causes the application of a bending moment to the frame member 13 and the driving shaft 16. However, in the above described embodiment, the cylinder 18 is secured to the frame member 13 (or to the main bearing 17) at positions intermediate between one of the securing positions of the main bearing, which is nearest to the cylinder 18, and the driving shaft 16. Thus, a portion C-D between the bolted portions C and D (see FIG. 3) to which a largest bending moment is applied due to the reaction force is formed to be a thickness corresponding to the sum of the thickness $t_0$ of the frame member 13 and the thickness $t_1$ of the flange portion 17*a* of the main bearing 17, that is $t_0+t_1$, and hence the rigidity of the portion C-D is made much larger than the rigidity of the corresponding part of the conventional construction, thus improving the rigidity of the entire frame member remarkably.

Additionally, the cylinder 18 of the compression mechanism 11 is provided with an end portion provided with projections 50, 51 (see FIG. 6) with a recess 52, formed therebetween. These end portions are secured by fasteners 27. This arrangement makes it possible to locate a part of the outer peripheral portion of the driving shaft 16 (see FIG. 5) of the motor within the recess 52.

As described hereinbefore, the outer end of the cylinder 18 of the compression mechanism 11 is closed by the valve cover 23 which is formed integrally with the delivery side muffler 24 made of a metal plate. Ordinarily the delivery side muffler 24 is provided for suppressing the pulsation in pressure of the coolant gas, and formed into a multistage construction having internally a required number of separating plates. However, when the number of the separating plates is increased to 2 or more, the joining work between the separating plates and the interior of the muffler becomes difficult, and in a case where the separating plates extend horizontally, communication holes provided in the central portion thereof tend to be closed by a brazing material used in the joining operation. Furthermore, the assembling of the muffler 24 has been troublesome because of the necessity of jigs and the like. Another construction having a second muffler coupled to the outside of a principal muffler for the purpose of increasing the pulsation reducing capability requires a larger space and hence is not economical.

These difficulties of the conventional delivery side muffler can be obviated by improved constructions of the same as shown in FIGS. 7A and 7B. In these constructions, second stage mufflers 36A and 36B are provided internally of first stage mufflers 34A and 34B, respectively. Delivery tubes 37A and 37B extending outwardly from the second stage mufflers 36A and 36B are lightly pressed into the openings, not numbered, of the first stage mufflers 34A and 34B, respectively, and secured thereto by brazing. The delivery tube 37A of the example shown in FIG. 7A is made separately from the second stage muffler 36A, while the delivery tube 37B of the example shown in FIG. 7B is made integrally with the second stage muffler 36B.

Since the second stage mufflers 36A and 36B are provided internally of the first stage mufflers 34A and 34B, respectively, the spaces required for these constructions can be economized, and the volumes of the delivery thereof can be increased. Furthermore, the delivery side muffler is made of a metal plate in two stages, so that the pulsation in pressure of the delivered coolant can be suppressed remarkably. In a case where the second stage muffler 36A or 36B is secured in the first stage muffler 34A or 34B, the delivery tube 37A or 37B is inserted in the opening or hole of the first stage muffler 34A or 34B in a lightly pressed manner, so that the second stage muffler 36A or 36B can be easily secured, for instance, by brazing. As a consequence, jigs and the like are not required any more, and the construction cost of the delivery side muffler can be substantially reduced.

Although in the above described embodiment, the cylinder of the compression mechanism and the main bearing supporting the driving shaft of the electric motor are secured to the frame member or to the flange portion of the main bearing by means of securing bolts, it is apparent that these may be secured to the same by means of screws and the like.

According to the invention, since the positions at which the cylinder of the compression mechanism is secured to the frame member or to the main bearing are selected between a cylinder-side securing position, that is one of the positions nearest to the cylinder, of the main bearing and the driving shaft of the electric motor, the thickness of a portion of the frame member to which the bending moment is applied can be increased effectively, and the rigidity of this portion can be substantially increased. Thus, the rigidity of the entire frame member can be improved, and the air gap between the stator and the rotor of the electric motor can be held in a constant value. This in turn improves the starting characteristics and the stability in operation of the electric motor, and the reliability thereof can be highly enhanced.

What is claimed is:

1. An enclosed type compressor comprising:

an enclosed-type casing;

a compressor mechanism provided in said casing and comprising a cylinder and a piston reciprocatable horizontally in said cylinder, and end portion of said cylinder being provided with projecting portions and a recess formed between said projecting portions as viewed in a plan view;

an electric motor comprising a stator, a rotor, and an output shaft extending vertically in said casing for driving said piston in a crank driving manner;

a main bearing which supports said output shaft rotatably;

a frame member made of a metal plate extending substantially horizontally in said casing;

first securing means for securing said main bearing to said frame member at a plurality of positions on both sides of said output shaft; and second securing means for securing said cylinder of said compression mechanism at said projecting portions of said cylinder so that a part of the outer peripheral portion of said output shaft is intruded into said recess of said cylinder end portion.

2. An enclosed type compressor according to claim 1 wherein said cylinder is secured by said second securing means to said frame member.

3. An enclosed type compressor according to claim 1 wherein said cylindr is secured by said second securing means to said main bearing.

4. An enclosed type compressor comprising:

an enclosed-type casing;

a compressor mechanism provided in said casing and comprising a cylinder and a piston reciprocatable horizontally in said cylinder;

an electric motor comprising a stator, a rotor, and an output shaft extending vertically in said casing;

a main bearing which supports said output shaft and permits said output shaft to rotate, said main bearing including a flange portion;

a frame member made of a metal plate extending substantially horizontally in said casing;

first securing means for securing said main bearing to said frame member at a plurality of first positions both sides of said output shaft, said first securing means extending through said flange portion of said main bearing into said frame member; and second securing means for securing said cylinder of said compression mechanism to said frame member at a plurality of second positions, wherein said second positions are located imtermediately between one of said plurality of first positions that is adjacent to said cylinder and said output shaft, and said second positions are spaced inwardly toward said output shaft from said first position that is adjacent to said cylinder by a distance m, such that the largest bending moment due to a reaction force is applied to a portion C-D which is comprised of a thickness corresponding to the sum of the thickness of said frame member and the thickness of said flange portion.

* * * * *